US009447727B2

(12) United States Patent
Klarer

(10) Patent No.: US 9,447,727 B2
(45) Date of Patent: Sep. 20, 2016

(54) VARIABLE DISPLACEMENT ENGINE

(75) Inventor: Mark William Klarer, Louisville, KY (US)

(73) Assignee: Mark William Klarer, Louisville, KY (US)

( * ) Notice: Subject to any disclaimer, the term of this patent is extended or adjusted under 35 U.S.C. 154(b) by 463 days.

(21) Appl. No.: 12/978,482

(22) Filed: Dec. 24, 2010

(65) Prior Publication Data

US 2012/0160216 A1 Jun. 28, 2012

(51) Int. Cl.
*F02B 75/04* (2006.01)

(52) U.S. Cl.
CPC ..... *F02B 75/048* (2013.01); *F02B 75/045* (2013.01)

(58) Field of Classification Search
CPC ..... F02B 75/048; Y10T 74/2181; Y10T 74/18208; Y10T 74/18272; F02D 15/02; F16C 3/28; F16C 21/22; F04B 9/04
USPC ..... 123/48 B, 197.1, 197.4, 78 F
See application file for complete search history.

(56) References Cited

U.S. PATENT DOCUMENTS 3,686,972 A * 8/1972 McWhorter ..... 74/602
3,861,239 A * 1/1975 McWhorter ..... F02B 41/04 123/197.4
4,152,955 A * 5/1979 McWhorter ..... F01B 9/02 123/48 B
4,301,695 A * 11/1981 Reiher ..... F02B 75/048 123/78 F
5,178,038 A * 1/1993 Heniges ..... F16F 15/26 123/78 F
5,201,287 A * 4/1993 Blish ..... 123/48 B
5,406,911 A * 4/1995 Hefley ..... F02B 75/045 123/48 B
5,927,236 A * 7/1999 Gonzalez ..... F02B 75/048 123/197.4
6,167,851 B1 * 1/2001 Bowling ..... F02B 75/048 123/48 B
6,453,869 B1 * 9/2002 Moore ..... F02B 75/048 123/197.4
6,732,683 B2 * 5/2004 Weiss ..... 123/48 B
7,076,948 B2 * 7/2006 Ito et al. ..... 60/486
7,185,557 B2 * 3/2007 Venettozzi ..... 74/602
2006/0053964 A1 * 3/2006 Venettozzi ..... F02B 75/048 74/595
2006/0231074 A1 * 10/2006 Ueno et al. ..... 123/399
2007/0056552 A1 * 3/2007 Fisher ..... 123/197.4
2011/0226220 A1 * 9/2011 Wilkins ..... F02B 75/044 123/48 B
2011/0262239 A1 * 10/2011 Tokawa ..... B23F 5/16 409/34

* cited by examiner

*Primary Examiner* — Marguerite McMahon
*Assistant Examiner* — James Kim

(57) ABSTRACT

A variable displacement engine includes sets of concentric gears with the crankshaft connected through gear trains to control the crankshaft radius and the piston rod length. One or more servos control the crankshaft concentric gears through gear trains to thus control the crankshaft radius and piston rod length, thereby controlling the engine displacement while maintaining compression ratio, and optionally controlling compression ratio independently.

4 Claims, 8 Drawing Sheets

VARIABLE DISPLACEMENT ENGINE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates to internal combustion engines, specifically to variable displacement engines.

2. Prior Art

An internal combustion heat engine is needed to convert chemical energy to mechanical power. These type of engines are very popular due to a number of factors such as ease of refueling, quick refuel times and typical range of hundreds of miles. Engines are designed for a vehicle based mainly on vehicle weight, the larger the vehicle, the larger the engine required. Typically, an internal combustion engine is designed with a fixed displacement. Unfortunately, the larger the displacement, the more work is required to push against the atmosphere. Since full power capacity is not required at all times, it would be desirable to have an engine with a variable displacement. An engine with variable displacement could reduce its displacement to conserve energy when traveling at low speeds, or downhill, or coasting to a stop. An engine with variable displacement could also increase its displacement when needed, such as when moving uphill, accelerating, traveling at high speed, or carrying a heavy load.

Prior art uses a variety of techniques to vary displacement: axial engines, z cranks, active cylinder management, cam on crankshaft, rocker rod, and many others. One technique is active cylinder management, that controls displacement by turning off and on fuel supply to cylinders, for example in U.S. Pat. No. 4,494,503 (1985) to Danno. Active cylinder management while somewhat practical, suffers from a small savings of approximately 15%, because all cylinders still must work against the atmosphere. Another technique achieves variable displacement by varying the stroke of a piston. A prior art example of stroke adjustment varies the angle of a rotating plate on the crankshaft connected to axially mounted cylinders, U.S. Pat. No. 5,113,809 (1992) to Ellenburg. The angled plate design has too many drawbacks to be useful, being very difficult to adjust displacement under power, bulky design, and excessive vibration. Another technique achieves variable displacement by varying the stroke of the piston in U.S. Pat. No. 6,938,589 (2005) to Park, by adjusting an angled crankshaft, or the Z type crankshaft. The angled crankshaft technique would be prone to balance problems resulting in undesired vibrations and cylinders with different simultaneous stroke lengths, resulting in decreased energy savings. The Z type crankshaft in U.S. Pat. No. 6,938,589 would have to be much longer than a conventional crankshaft, and would result in a very large and massive engine. Another problem in U.S. Pat. No. 6,938,589 would be lack of controlling displacement under power, as the design does not explain how large forces from engine torque would be overcome during adjustment, namely between the piston and sliding crankshaft. U.S. Pat. No. 6,938,589 also does not explain how the engine will maintain balance or compression ratio adjustments while adjusting the displacement. Another example of prior art, in U.S. Pat. No. 5,406,911 (1995) to Hefly, controls displacement and independently controlling compression ratio by rotating a cam on the crankshaft and adjusting piston arm length by rotating the piston. While U.S. Pat. No. 5,406,911 is the most sound of all prior art examples, there are three major flaws in the design. The first flaw is the adjustment of displacement using a rotating cam on crankshaft will result in a timing error with respect to crankshaft, valves, and ignition timing. Another flaw is the adjustment requires the use of a servo motor mounted on the crankshaft where electric power and electronic signals would be difficult to route to while the crankshaft rotates. Another flaw that could perhaps be fixed easily is the piston arm adjustment uses a gear meshing with an elongated piston. The increased piston cylinder will increase the engine size modestly, however the biggest flaw in this design is the friction between the gear and cylinder would quickly wear the gear and piston, resulting in decreased engine and piston arm control life. A technique that can finely adjust the piston stroke of the engine would be highly desirable, as it would allow greater savings in energy than other designs. A design that has the most control over piston stroke length would be the most desirable of these type of variable displacement engines. A design with the most compact, and least amount of vibrations is also desirable. A design that can adjust all cylinders to the same stroke length would be desirable. A design that uses positively engaged mechanical means to adjust the stroke length is preferred over designs that use hydraulics, pneumatics and friction, that are prone to shortened life due to increased wear of parts.

SUMMARY

The invention provides a most desirable solution to a variable displacement engine, allowing very accurate control of piston stroke length and compression ratio under full power conditions, by using a plurality of positively engaged gear trains.

DRAWINGS

Figures

Figure 4:
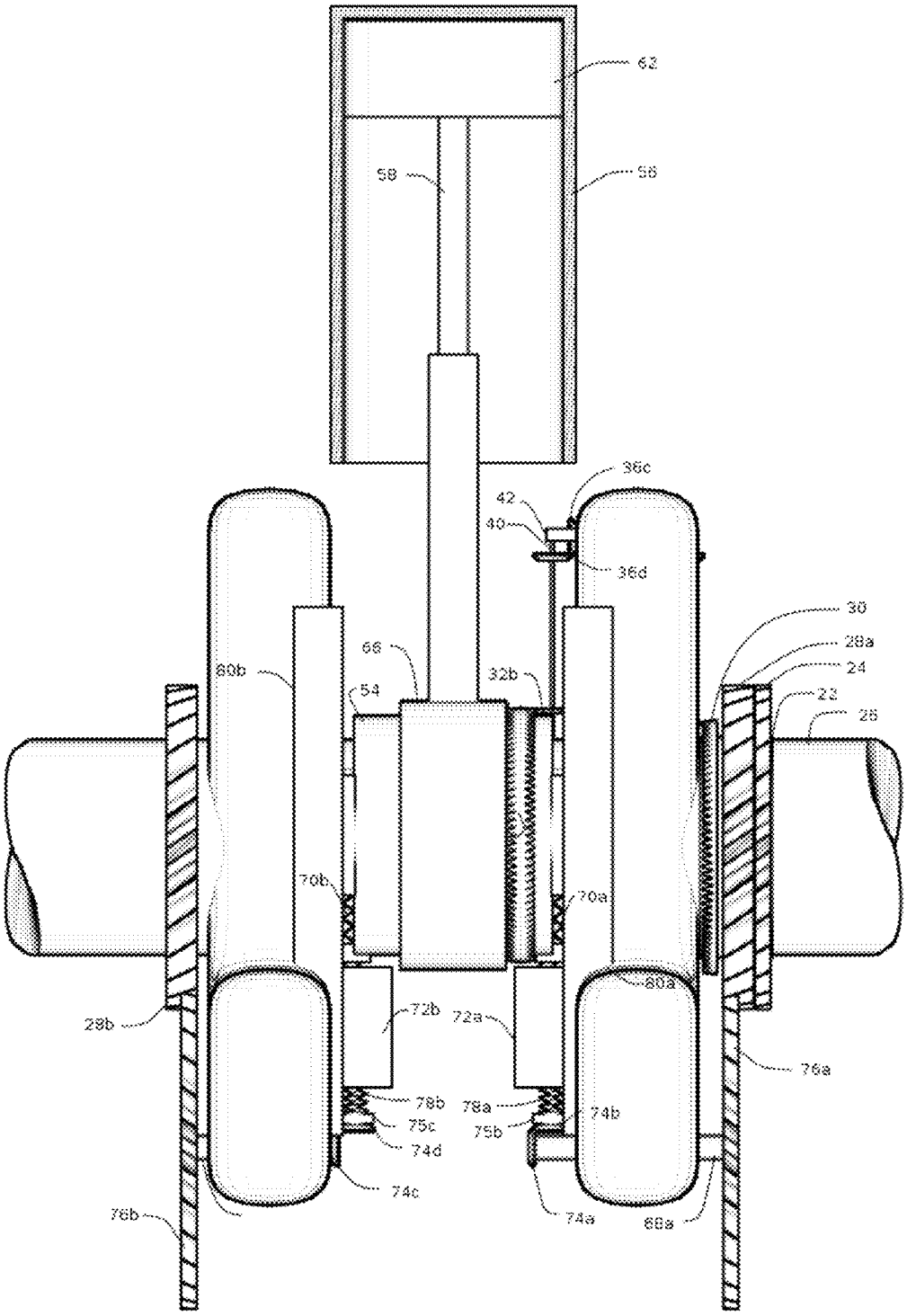

FIG. 4. shows the cylinder configured for minimum displacement at top dead center.

Figure 5:
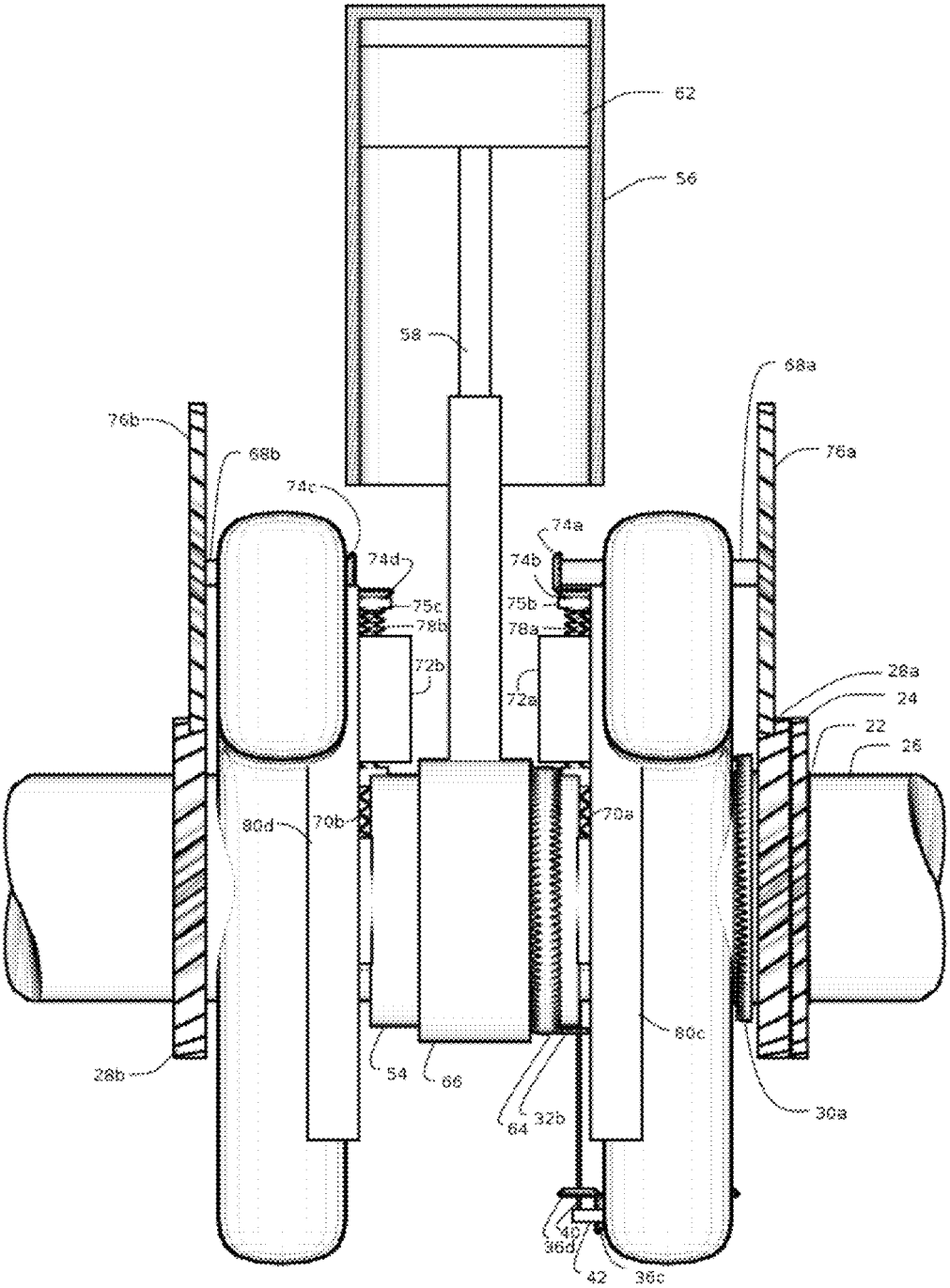

FIG. 5. shows the cylinder configured for minimum displacement at bottom dead center.

Figure 6:
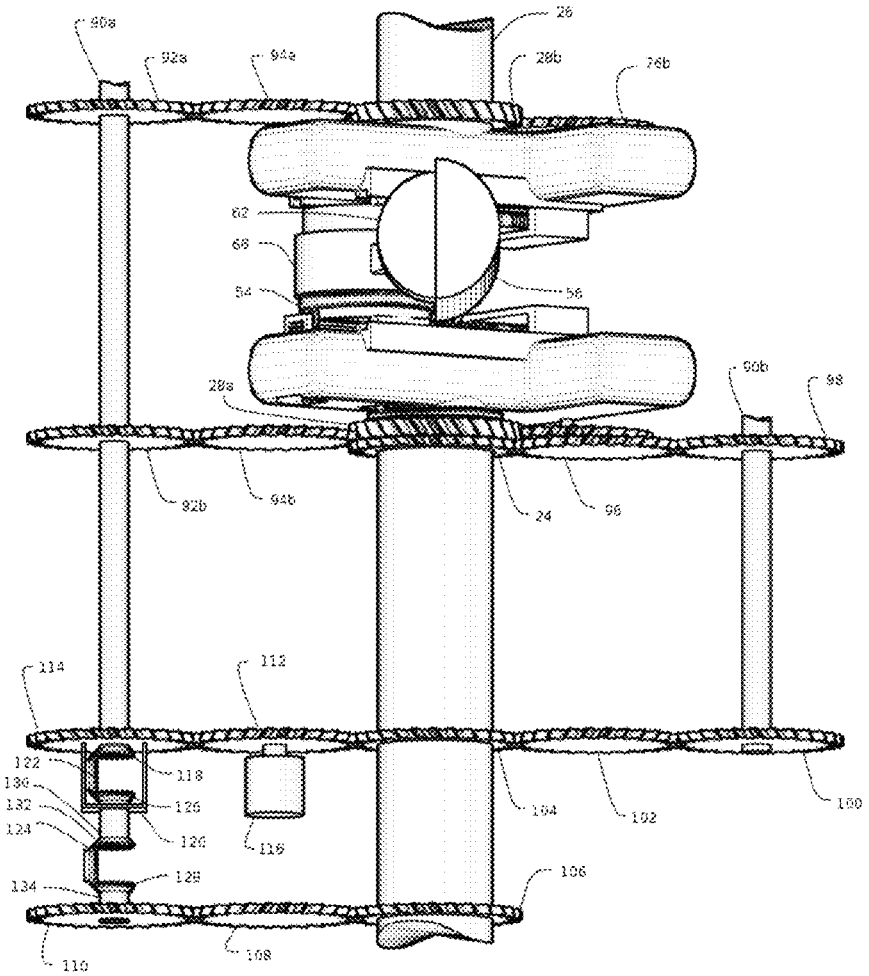

FIG. 6. shows the servo and associated gear trains between the servo and a cylinder.

Figure 7:
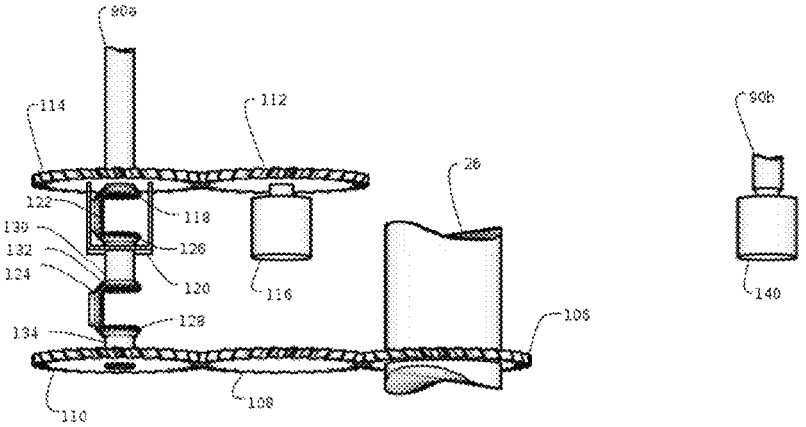

FIG. 7. shows a two servo configuration.

Figure 8:
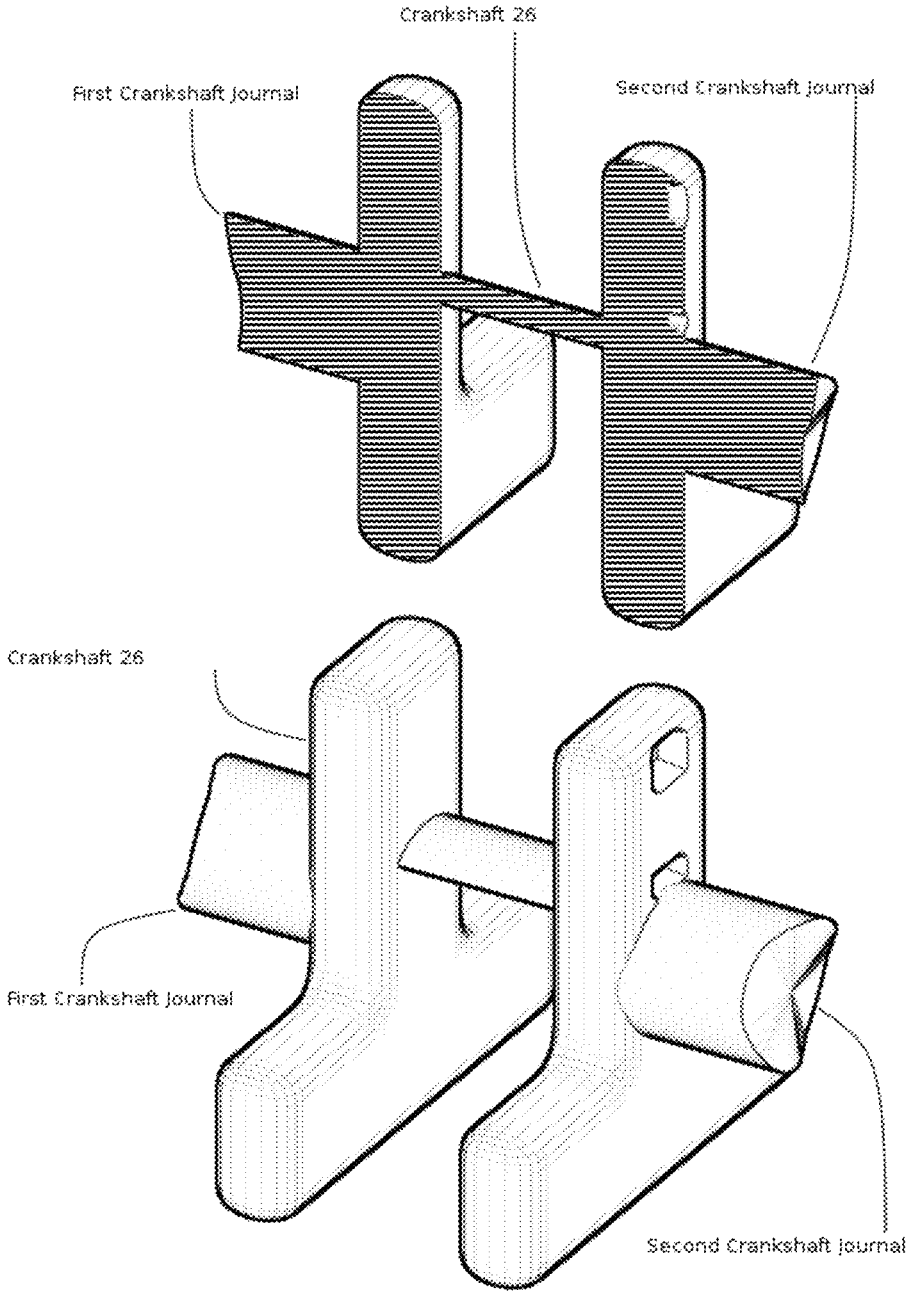

FIG. 8. shows the crankshaft portion isolated for detail and also with cutaway view.

DETAILED DESCRIPTION

Referring to the drawings, a preferred embodiment of the present invention is described. A single engine cylinder is show in the drawings for simplicity. The changes represented in this invention to an engine cylinder can be easily duplicated for all cylinders in a multiple cylinder engine. In addition, the invention can be applied to nearly all types of internal combustion cylinder type engines, whether they are diesel, gasoline, in-line, boxer, V8, V6 4 cylinder, etc. All moving parts are held rotatable or moveable with bearings to minimize friction unless stated otherwise. This includes but is not limited to: axles, worm gears, rotating rings, guide rails and rollers in tracks. The crankshaft in this invention can be a solid machined piece of material for greatest strength and power transmission. Small holes can be drilled to allow control axles and gears to operate inside and near the crankshaft.

Figure 1:
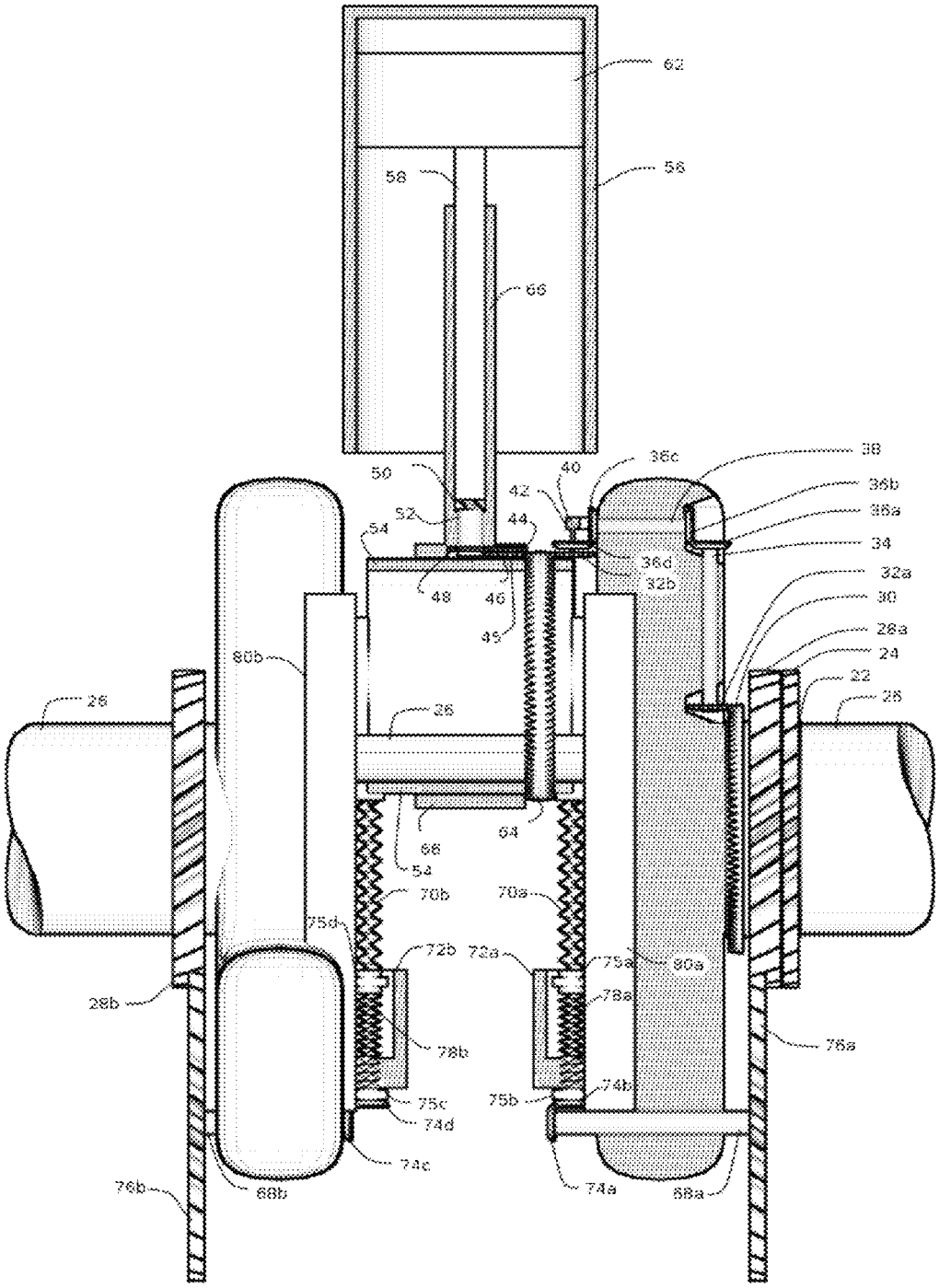
FIG. 1 is a cutaway detail of gear trains for adjusting a cylinder.

Referring particularly to FIG. 1, the detail of gear trains for adjusting a cylinder is explained. The gears required for each cylinder can be viewed as either for adjusting the piston rod length, or the crank pin radius.

The gear train for adjusting the piston rod 66 length uses an epicyclic gear train. An epicyclic gear train is implemented to control the piston rod length independent of crankshaft 26 rotations. Hollow axle 22 is concentric to and rotates freely around crankshaft 26. Gear 24 and gear 30 are fixed to and rotate with hollow axle 22. Gear 32*a* meshes with gear 30. Gear 32*a* and gear 36*a* are fixed to and rotate with axle 34. Gear 36*b* meshes with gear 36*a*. Gear 36*b* and gear 36*c* are fixed to and rotate with axle 38. Gear 36*d* meshes with gear 36*c*. U shaped bracket 42 is fixed to crankshaft 26. Grooved axle 40 is used to transmit rotations independent of the position of adjustable crank pin 54. Grooved axle 40 is held rotatable with bracket 42 on one end and crankshaft 26 on the other end. Gear 36*d* is fixed to and rotates with grooved axle 40. Gear 32*b* is held rotatable with adjustable crank pin 54. Grooved axle 40 holds gear 32*b* slidable and also are fixed to rotate together. Adjustable crank pin 54 holds double sided crown gear 64 rotatable. Gear 46 meshes with gear 64. Adjustable piston rod 66 holds axle 45 rotatable. Gear 46 and gear 44 are fixed to and rotate with axle 45. Gear 48 meshes with gear 44. Adjustable piston rod 66 holds axle 52 rotatable. Gear 48 and ball screw 50 are fixed to and rotate with axle 52. Piston rod extension 58 is attached to ball screw 50. Piston 62 is hinged to piston rod extension 58. Piston 62 slides up and down cylinder 56. In this configuration, gears 30, 32*a*, 36*a*, 36*b*, 36*c*, 36*d*, 32*b*, and 64 form an epicyclic set where gear 64 matches gear 30's rotation, and is not affected by crankshaft 26 rotations. Further, since gear 24 rotates with gear 30, and gears 46, 44, and 48 mesh with gear 64, gear 24 controls rotations of gear 48 independent of crankshaft 26 rotations. Further, since piston rod extension 58 is attached to ball screw 50, and ball screw 50 rotates with gear 48, gear 24 rotations control the piston rod extension 58. Therefor, gear 24 controls the piston rod length for piston 62. Small intermittent changes to piston rod extension 58 will be present due to the angle change with respect to cylinder 56. The formula being: piston rod extension 58 intermittent change=f*sin(angle piston arm extension 58), where f is the final gear ratio of ball screw 50. The intermittent change is not cumulative over crankshaft 26 revolutions. This will not affect timing or any other factor since the angle at top dead center and bottom dead center are both at 0 degrees.

In normal operations, gear 24 will remain motionless during crankshaft 26 rotations while no adjustment to displacement is required. During periods of adjustment, gear 24 rotations will cause changes in piston rod lengths for piston 62.

Figure 3:
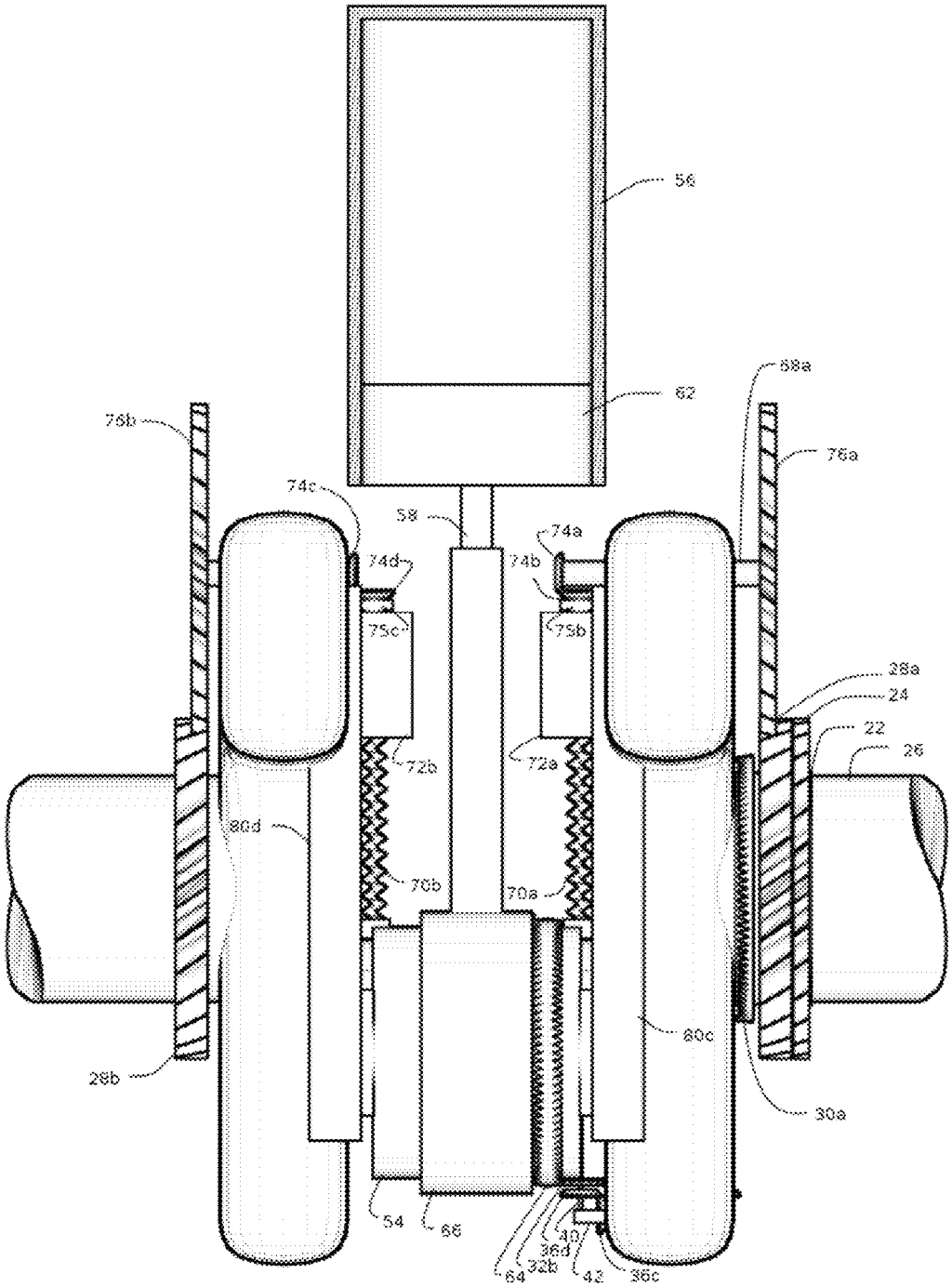
FIG. 3 shows the cylinder configured for maximum displacement at bottom dead center.

Referring particularly to FIG. 1 and FIG. 3, the gear train for controlling crankshaft 26's radius uses the gears 28*a* and 28*b* concentric to the crankshaft 26. Two nearly identical gear trains are implemented on either side in order to balance the forces for controlling the radius.

On one side, crankshaft 26 concentric gear 28*a* meshes with gear 76*a*. Gear 28*a* is also concentric to and rotates freely around hollow axle 22. Crankshaft 26 holds axle 68*a* rotatable. Gear 76*a* and gear 74*a* are fixed to and rotate with axle 68*a*. Gear 74*b* meshes with gear 74*a*. Gear 74*b* is attached to and rotates with ball screw 78*a*. Brackets 75*a* and 75*b* are fixed to crankshaft 26. Brackets 75*a* and 75*b* hold ball screw 78*a* rotatable. Ball screw 78*a* rotations move counterweight 72*a* along track rollers 80*a* and 80*c*. Ball screw 70*a* is attached to and rotates with ball screw 78*a*. Bracket 75*a* and crankshaft 26 hold ball screw 70*a* rotatable. Ball screw 70*a* rotations move adjustable crank pin 54 along track rollers 80*a*, 80*b*, 80*c*, and 80*d*.

On the other side, crankshaft 26 concentric gear 28*b* meshes with gear 76*b*. Crankshaft 26 holds gear 28*b* rotatable, and are not fixed to rotate together. Crankshaft 26 holds axle 68*b* rotatable. Gear 76*b* and gear 74*c* are fixed to and rotate with axle 68*b*. Gear 74*d* meshes with gear 74*c*. Gear 74*d* is attached to and rotates with ball screw 78*b*. Brackets 75*c* and 75*d* are fixed to crankshaft 26. Brackets 75*c* and 75*d* hold ball screw 78*b* rotatable. Ball screw 78*b* rotations move counterweight 72*b* along track rollers 80*b* and 80*d*. Ball screw 70*b* is attached to and rotates with ball screw 78*b*. Bracket 75*d* and crankshaft 26 hold ball screw 70*b* rotatable. Ball screw 70*b* rotations move adjustable crank pin 54 along track rollers 80*a*, 80*b*, 80*c*, and 80*d*.

As gears 28*a* and 28*b* rotate with respect to crankshaft 26 rotations, counterweights 72*a* and 72*b* will move along track rollers 80*a*, 80*b*, 80*c* and 80*d*. Also, as gears 28*a* and 28*b* rotate with respect to crankshaft 26 rotations, adjustable crank pin 54 will move along track rollers 80*a*, 80*b*, 80*c* and 80*d* in an opposite direction as counterweights 72*a* and 72*b* to maintain crankshaft balance.

Referring particularly to FIG. 1, crankshaft 26 is a solid one piece construction that extends from the left of the drawing, through the middle, and to the right of the drawing. Adjustable crank pin 54 is of hollow tube shape, allowing it to move up and down with respect to the drawing as crankshaft 26 radius is adjusted. The hollow shape for adjustable crank pin 54 allows crankshaft 26 to continue along the length of the engine in one continuous piece.

Operation and Control

Figure 2:
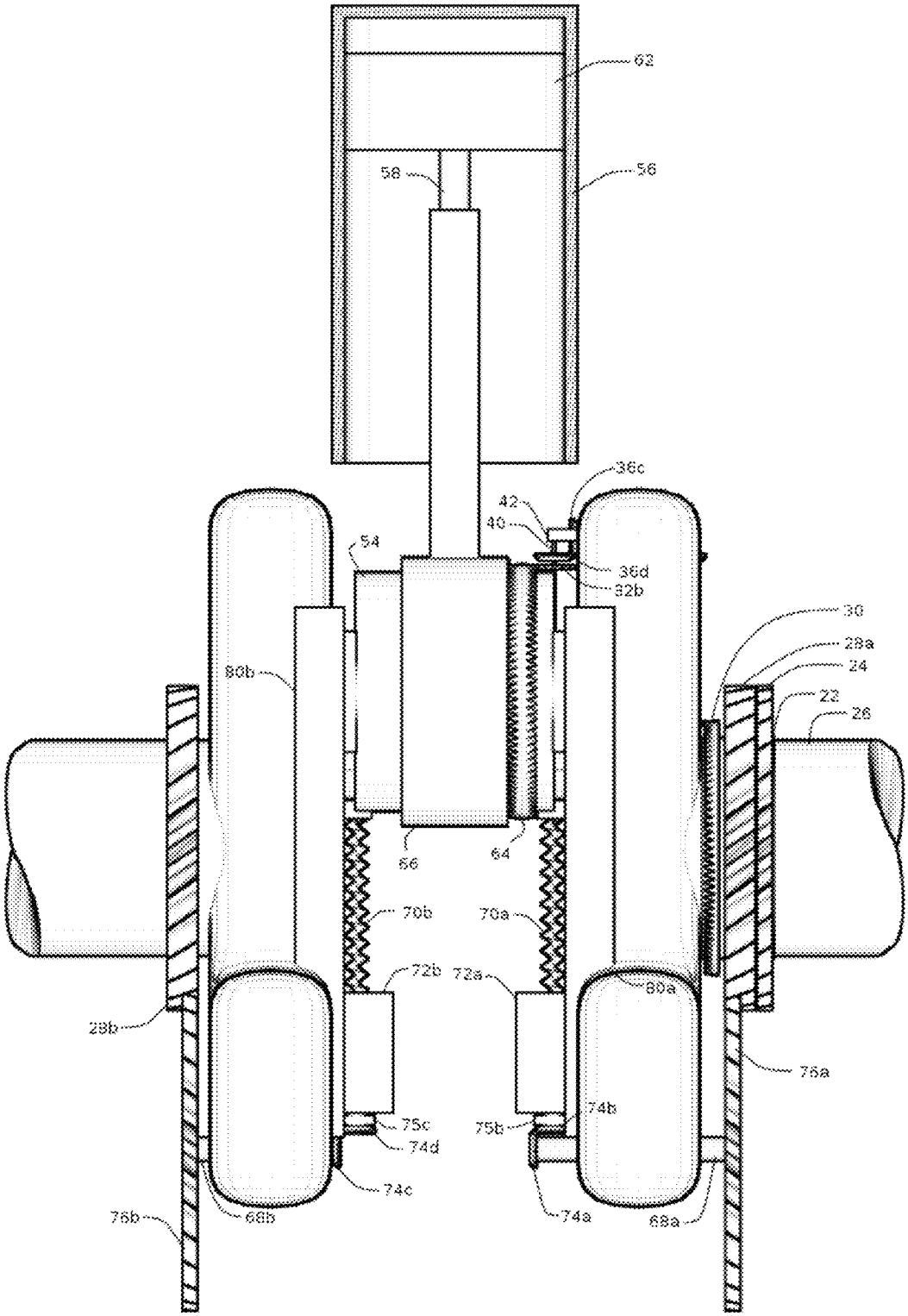
FIG. 2 shows the cylinder configured for maximum displacement at top dead center.

FIG. 2 and FIG. 3 show cylinder 56 configured for maximum displacement. Cylinder 56 is configured for maximum displacement by moving adjustable crank pin 54 to its extent away from crankshaft 26 center. Also, the piston rod extension 58 is retracted inside adjustable piston rod 66. Also, counterweights 72*a* and 72*b* are extended away from crankshaft 26 center. FIG. 2 shows cylinder 56 at top dead center. FIG. 3 shows cylinder 56 at bottom dead center. The ratio of volumes in the space above piston 62 and below cylinder 56 between these two positions is the compression ratio.

FIG. 4 and FIG. 5 show cylinder 56 configured for minimum displacement. Cylinder 56 is configured for minimum displacement by moving adjustable crank pin 54 to its extent towards crankshaft 26 center. Also, the piston rod extension 58 is extended outside adjustable piston rod 66. Also, counterweights 72*a* and 72*b* are moved towards the center of crankshaft 26. FIG. 4 shows cylinder 56 at top dead center. FIG. 5 shows cylinder 56 at bottom dead center. The ratio of volumes in the space above piston 62 and below cylinder 56 between these two positions is the compression ratio. The compression ratio for minimum displacement can be set to the same compression ratio as maximum displacement.

Cylinder 56 can be set to any displacement between maximum and minimum displacements. Compression ratio can be maintained regardless of the displacement. Also, due to the separate controls for the piston rod length 66 and crankshaft radius 26, the compression ratio may be adjusted for any displacement.

Referring to FIG. 6, servo 116 controls the displacement for cylinder 56. Gear 112 is attached to and rotates with the output of servo 116. Crankshaft 26 holds gear 104 rotatable, and are not fixed to rotate together. Gear 104 meshes with gear 112. Gear 102 meshes with gear 104. Gear 100 meshes with gear 102. Gear 100 and gear 98 are attached to and rotate with axle 90*b*. Gear 96 meshes with gear 98. Gear 24 meshes with gear 96. Thus, in the gear train described, from servo 116 to gear 24, and since gear 24 also sets the piston rod length for cylinder 56, servo 116 controls the piston rod length for cylinder 56.

Gear 106 is attached to and rotates with crankshaft 26. Gear 108 meshes with gear 106. Gear 110 meshes with gear 108. Gear 110 and gear 128 are attached to and rotate with axle 134. Gear 124 meshes with gear 128. Gear 132 meshes with gear 124. Gear 126 and gear 132 are attached to and rotate with axle 130. Gear 128, gear 124, and gear 132 are configured as a reversing set, in which axle 130 rotates opposite of gear 134, and thus opposite crankshaft 26. Differential housing 120 holds gear 122 rotatable. Gear 122 meshes with gear 126 and also meshes with gear 118. Gear 112 meshes with gear 114. Gear 114 is attached to and rotates with differential housing 120. Axle 90*a* holds gear 114 and differential housing 120 rotatable. Gear 118 is attached to and rotates with axle 90*a*. Due to the reversing configuration of gear 122, gear 126, and gear 118, axle 90*a* rotates opposite of axle 130, and further, axle 90*a* rotates with crankshaft 26. Thus, since gear 114 rotates with differential housing 120, and meshes with gear 112, servo 116 rotations are added to crankshaft 26 rotations into axle 90*a*. The relationship between servo 116, crankshaft 26 and axle 90*a* can be understood using a standard differential gear unit, where two axle rotations added together equals a third axle's rotation. Gear 92*b* and gear 92*a* are attached to and rotate with axle 90*a*. Gear 94*b* meshes with gear 92*b*. Gear 94*b* meshes with gear 28*a*. Gear 92*a* meshes with gear 94*a*. Gear 28*b* meshes with gear 94*a*. Since gear 28*b* and gear 28*a* rotations with respect to crankshaft 26 control the crankshaft 26 radius, and since servo 116 rotations are added to crankshaft 26 rotations into axle 90*a*, servo 116 controls crankshaft 26 radius.

The final gear ratio between servo 116 rotations and piston rod length 66 adjustments can be changed through any of the gears in the gear train, including the ball screw 50 mechanical advantage for adjustable piston rod 66. The final gear ratio between servo 116 rotations and crankshaft 26 radius can be changed through different gear ratios, including the ball screw mechanical advantage of ball screws 70*a* and 70*b*. The ratio of movement for adjustable piston rod 66 and crankshaft 26 radius must be properly set in order that the compression ratio is maintained from minimum to maximum displacements.

Alternative Embodiments

Referring particularly to FIG. 7, an alternative embodiment using separate servos for controlling adjustable piston rod 66 and crankshaft 26 radius is shown. The alternative embodiment is the same as the preferred embodiment with the difference that servo 116 no longer controls axle 90*b*. Referring to FIG. 6, this is accomplished by removing gear 100 and gear 102 and gear 104. Referring to FIG. 7, servo 140 is attached to axle 90*b*. Since the rest of the gear trains are not changed, servo 140 thus controls the adjustable piston rod 66 length. Servo 140 and servo 116 can now be adjusted separately to independently control the crankshaft 26 radius and the adjustable piston rod 66 length.

CONCLUSION, RAMIFICATIONS, AND SCOPE

Accordingly, the variable displacement engine has distinct advantages over other methods of varying engine displacement. For one, it allows greater control of displacement. Further, it has additional advantages in that it can control engine displacement without affecting timing of other engine components such as valves and electrical ignition;

it can control engine displacement without affecting compression ratio;

it can control engine displacement and compression ratios independently;

it can control engine displacement and compression ratio very accurately by using well engineered gear trains;

it can control engine displacement and compression ratio by slightly modifying existing design parameters of internal combustion engines without using radically different designs, such as an axial engine design;

it can help reduce fuel consumption and costs dramatically;

it can control displacement and compression ratio under any engine load and rpm;

it can control displacement and compression ratio using well designed gear trains that will not wear out before other engine components, such as piston rings and valves;

it can finely control displacement and compression ratio, limited only by gear and servo accuracy;

it can control displacement and compression ratio with only minimal increase in engine size and mass, since most of the gears used are small, or can be made very thin, due to very little torque required on nearly all gears.

Although my above description contains many specificities, these should not be construed as limitations on the scope of the invention, but rather as the exemplification of one major embodiment thereof. Many other variations are possible.

A different set of gear trains may be employed in order to minimize space requirements. In particular, the gear trains from one or more servos to a cylinder may be drastically reduced in size. The gear trains from servo to cylinder may also employ bevel gears and axles versus helical gears to greatly reduce size requirements. Although much research has been done to minimize the number of gears necessary, a different combination of epicyclic and differential configurations may be employed between the crankshaft and adjustable piston rod and the adjustable crank pin to optimize a particular implementation.

Therefore, the scope of the invention should be determined by the appended claims and their legal equivalents, rather than by the examples given.

I claim:

1. In a variable displacement engine, a system for changing the radius of a crankpin's revolution thereby changing the displacement of the engine comprising:

a portion of a crankshaft from a single or multiple cylinder engine having a first and second journal, wherein said crankshaft portion rotates about an axis of rotation;

a crankpin separate from said crankshaft portion revolving about said axis of rotation and also located between said first and said second crankshaft journals wherein said crankpin is held slidably attached to said first and said second crankshaft journals through a linear motion assembly such that the crankpin distance from said axis of rotation is adjustable and moves in a straight line from said axis of rotation;

a gear train including a concentric gear with respect to said axis of rotation, whereby rotations of said concentric gear with respect to said axis of rotation will control said crankpin distance from said axis of rotation through the gear train;

said gear train also including one or more linear actuators attached to said crankpin, wherein activating said linear actuators by means of said gear train moves said crankpin along said linear motion assembly thereby controlling said crankpin distance from said axis of rotation.

2. The variable displacement engine of claim 1 wherein said concentric gear is controlled by a computer controlled servo through a second gear train.

3. The variable displacement engine of claim 2 wherein said second gear train includes a differential gear set that adds said servo rotation to said axis of rotation's angle, whereby rotations of said servo will cause said concentric gear to rotate with respect to said axis of rotation and thereby control said crankpin distance from said axis of rotation.

4. The variable displacement engine of claim 1 wherein said linear actuator is a screw mechanism.

* * * * *